US007753174B2

(12) United States Patent
Reuter

(10) Patent No.: US 7,753,174 B2
(45) Date of Patent: Jul. 13, 2010

(54) ELEVATOR INSTALLATION

(75) Inventor: Guenter Reuter, Filderstadt (DE)

(73) Assignee: ThyssenKrupp Elevator AG, Duesseldolf (DE)

( * ) Notice: Subject to any disclaimer, the term of this patent is extended or adjusted under 35 U.S.C. 154(b) by 0 days.

(21) Appl. No.: 11/899,989

(22) Filed: Sep. 7, 2007

(65) Prior Publication Data

US 2008/0060881 A1 Mar. 13, 2008

Related U.S. Application Data

(63) Continuation of application No. PCT/EP2005/011545, filed on Oct. 28, 2005.

(30) Foreign Application Priority Data

Mar. 12, 2005 (EP) ..... 05005444

(51) Int. Cl.
*B66B 9/00* (2006.01)
*B66B 11/08* (2006.01)

(52) U.S. Cl. ..... 187/249; 187/257; 187/258; 187/266

(58) Field of Classification Search ..... 187/249, 187/257, 258, 266, 404
See application file for complete search history.

(56) References Cited

U.S. PATENT DOCUMENTS 1,164,115 A 12/1915 Pearson
1,763,198 A 6/1930 Sprague
1,782,671 A * 11/1930 Allred, Jr. ..... 414/263
1,805,227 A 5/1931 Rugg
RE18,095 E 6/1931 Sprague
1,837,643 A * 12/1931 Anderson ..... 187/249
1,896,776 A 2/1933 James
1,911,834 A * 5/1933 Lindquist ..... 187/249
5,076,398 A 12/1991 Heikkinen
5,398,781 A 3/1995 Biewald et al.
5,419,414 A 5/1995 Sakita
5,490,577 A 2/1996 Yoo (Continued)

FOREIGN PATENT DOCUMENTS

DE 884 562 8/1953

(Continued)

OTHER PUBLICATIONS

Patent Abstracts of Japan, vol. 018, No. 310 (M-1620), Jun. 14, 1994, Abstract of Japanese Patent "Elevator-Driving System," Publication No. 06 064863, Mar. 8, 1994.

*Primary Examiner*—John Q Nguyen
*Assistant Examiner*—Stefan Kruer
(74) *Attorney, Agent, or Firm*—Lipsitz & McAllister, LLC

(57) ABSTRACT

The invention relates to an elevator installation with a number of cars in a shaft, with a second car disposed underneath a first car. Associated with each car is a drive with a traction sheave and at least one cable strand, which is led over the traction sheave and by means of which the car is connected to a counterweight. The second car is kept in a suspension ratio of 1:1 and is connected to its counterweight by means of two cable strands associated with different sides of the second car and led over the traction sheave of the second car. A cable guiding device is provided which subjects the two cable strands of the second car to equal loading.

19 Claims, 3 Drawing Sheets

U.S. PATENT DOCUMENTS

| | | | | |
|---|---|---|---|---|
| 5,564,530 | A | 10/1996 | Iwakiri et al. | |
| 6,223,862 | B1 | 5/2001 | Barnes | |
| 6,315,084 | B1 | 11/2001 | Shon | |
| 6,443,266 | B2 | 9/2002 | Murakami et al. | |
| 6,640,935 | B1 | 11/2003 | Murakami et al. | |
| 6,854,564 | B2 | 2/2005 | Reuter et al. | |
| 7,661,513 | B2 * | 2/2010 | Kocher | 187/249 |
| 2003/0075388 | A1 | 4/2003 | Reuter et al. | |
| 2008/0142310 | A1 * | 6/2008 | Kocher | 187/266 |

FOREIGN PATENT DOCUMENTS

| | | |
|---|---|---|
| DE | 2 209 455 | 9/1973 |
| DE | 39 07 541 | 9/1989 |
| DE | 198 35 960 | 2/2000 |
| DE | 199 63 286 | 7/2001 |
| DE | 101 45 744 | 4/2003 |
| EP | 0 554 712 | 8/1993 |
| EP | 0 578 237 | 1/1994 |
| EP | 1 006 071 | 6/2000 |
| EP | 1 123 891 | 8/2001 |
| EP | 1 302 431 | 4/2003 |
| EP | 1 329 412 | 7/2003 |
| EP | 1 512 652 | 3/2005 |
| WO | 02/00541 | 1/2002 |
| WO | 02/38481 | 5/2002 |
| WO | 02/46082 | 6/2002 |
| WO | 02/070387 | 9/2002 |
| WO | 03/043924 | 5/2003 |

* cited by examiner

ELEVATOR INSTALLATION

This application is a continuation of international application number PCT/EP2005/011545 filed on Oct. 28, 2005.

The present disclosure relates to the subject matter disclosed in international application number PCT/EP2005/011545 of Oct. 28, 2005 and European application number 05 005 444.4 of Mar. 12, 2005, which are incorporated herein by reference in their entirety and for all purposes.

BACKGROUND OF THE INVENTION

The invention relates to an elevator installation with a number of cars in a shaft, a second car being disposed underneath a first car and there being associated with each car a drive with a traction sheave and also at least one cable strand, which is led over the traction sheave and by means of which the car is connected to a counterweight, the second car being kept in a suspension ratio of 1:1 and being connected to its counterweight by means of two cable strands associated with different sides of the second car and led over the traction sheave of the second car.

The use of a number of cars which can be made to travel up and down separately from each other in a common shaft allows the handling capacity of an elevator installation to be increased. The cars may be driven by means of traction sheaves, over which the cable strands which connect the cars to their counterweight are led. Only a single cable strand is required for the first car. Usually two cable strands are used for the second car, which is disposed underneath the first car, these cable strands being disposed on two different sides of the car and running laterally outside the first car. In U.S. Pat. No. 5,419,414, it is proposed for this purpose to lead the two cable strands of the second car respectively over a separate traction sheave, so that the drive of the second car takes place by means of two traction sheaves which are separated from each other by the width of the car and are coupled to a common drive motor by means of a drive shaft. However, this requires a separate drive motor with a long drive shaft for the second car and also requires a large shaft space, with the effect of increasing the production and operating costs of the elevator installation.

In EP-A-1 329 412, it is proposed to lead the two cable strands of the second car over a common traction sheave. This allows shaft space to be saved and a standard motor to be used for driving the second car. However, the two cable strands of the second car are worn in different ways during its operation, so that they reach their maximum permissible degree of wear at different points in time. To exchange the cable strands, the elevator installation has to be taken out of operation, and, in order to keep these inoperative times as short as possible, the two cable strands are usually exchanged at the same time, although strictly speaking only the more severely worn cable strand needs to be exchanged in this way, while the maximum permissible degree of wear has not yet been reached for the less worn cable strand.

It is an object of the present invention to develop an elevator installation of the type mentioned at the beginning in such a way that, as far as possible, the two cable strands of the second car reach their maximum permissible degree of wear at the same point in time, in order in this way to lower the operating costs.

SUMMARY OF THE INVENTION

This object is achieved according to the invention in the case of an elevator installation of the generic type by the traction sheave associated with the second car having two traction sheave parts, over each of which one of the two cable strands of the second car is led, the distance between the traction sheave parts being less than the distance between the two cable strands in the region of the second car, and by the elevator installation having a cable guiding device which subjects the two cable strands of the second car to equal loading. The loading of the cable lines is brought about not only by the tensile force to which the cable lines are subjected but also by the deflection of the cable lines at deflecting rollers and at the associated traction sheave. According to the invention, it is provided that the two cable strands of the second car are disposed and guided by means of the cable guiding device in such a way that they are exposed to virtually the same cable loading. They are therefore worn out equally and reach their maximum permissible degree of wear at approximately the same point in time. At this point in time, both cable strands can be exchanged, both exhibiting the same degree of wear. It is consequently not necessary for one of the cable strands to be exchanged before it has reached the end of its service life. The elevator installation according to the invention is therefore distinguished by lower operating costs.

A single traction sheave is used for driving the second car, over which sheave the two cable strands of the second car are led. The traction sheave has two traction sheave parts, over each of which one of the two cable strands is led. The distance between the traction sheave parts is less than the distance between the two cable strands in the region of the second car.

It may be provided in particular that the two traction sheave parts lie against each other. A configuration of the elevator installation of this type is distinguished by a particularly compact form of construction, which takes up relatively little shaft space.

The term car is used here to refer both to an elevator cabin without a car frame and to an elevator cabin including a car frame on which the elevator cabin is held. The cable strands may be fixed directly to the elevator cabin or else to the car frame that is possibly used.

The second car is kept in a suspension ratio of 1:1, that is to say the cable strands of the second car are fixed to it, so that the cable speed of the two cable strands is identical to the speed of the car. This allows running noises and vibrations in the second car to be kept down. The first car may also be kept in a suspension ratio of 1:1, so that the elevator installation according to the invention is distinguished overall by a low noise level. In the case of a suspension ratio of 1:1, a change in height of the car is identical to the advancement of the respective cable strands by means of which the car is connected to its counterweight.

In the case of the elevator installation according to the invention, standard drive motors may be used both for the first car and for the second car. This likewise allows the production and operating costs of the elevator installation to be lowered.

It is of advantage if the cable guiding device comprises deflecting rollers, the two cable strands of the second car being led over the same number of deflecting rollers and over the traction sheave of the second car. Since each cable strand undergoes wear both at deflecting rollers and at the traction sheave, the use of an equal number of deflecting rollers for the two cable strands has the effect that they are worn more equally.

It is advantageous if the cable guiding device comprises deflecting rollers, the distances between two adjacent deflecting rollers and between the traction sheave of the second car and deflecting rollers adjacent to this traction sheave being the same for both cable strands of the second car. The wear of the cable strands led over deflecting rollers and the traction sheave is also dependent on the distances between the respective deflecting rollers and between them and the traction sheave. If the distances coincide for the two cable strands, more equal wear of the cable strands of the second car can be achieved.

In the case of a particularly preferred embodiment of the invention, it is provided that the cable guiding device comprises deflecting rollers, the sequence of the changes in direction that take place at the respective deflecting rollers and the traction sheave of the second car being the same for the two cable strands of the second car. The bending direction experienced by the cable strands on account of the deflecting rollers and the traction sheave consequently coincides for the two cable strands. In particular, it is ensured as a result that a change in the bending direction takes place in the same way for both cable strands. Such a change in direction entails great loading of the respective cable strand. Ensuring that changes in direction coincide for both cable strands allows their loading, and consequently also their wear, to be made approximately the same.

It is of particular advantage if the cable guiding device comprises deflecting rollers, the two cable strands of the second car being deflected respectively by the same angle at mutually corresponding deflecting rollers and at the traction sheave of the second car. For instance, it may be provided that a deflecting roller at which the respective cable strand is in each case deflected by the same angle is disposed at the same height for each of the two cable strands, so that the cable strands are respectively subjected to the same loading and wear at the deflecting rollers and at the traction sheave.

In the case of a preferred embodiment, the two cable strands of the second car run mirror-symmetrically in relation to each other with respect to a plane of symmetry. Symmetrical running of the two cable strands allows particularly equal wear of the two cable strands to be achieved.

It is advantageous if the two cable strands of the second car have in each case a first cable strand portion, starting from the second car and extending as far as a first deflecting roller, and a second cable strand portion, joined to the first, the second cable strand portions being aligned perpendicularly in relation to the first cable strand portions. This makes it possible to bring the two cable strands which are led past different sides of the first car together in the second cable strand portion, in order in this way to save shaft space.

It is of advantage if the second cable strand portions are horizontally aligned. The cable strands of the second car consequently undergo a deflection of 90° as they extend from the second car at a first deflecting roller. The first cable strand portion that extends from the second car runs in a vertical direction past the first car and, after a deflection by 90°, the first cable strand portion is joined to the horizontally aligned second cable strand portion.

The second cable strand portion may extend as far as a second deflecting roller, at which it is joined to a third cable strand portion. Here it is advantageous if the third cable strand portions of the two cable strands of the second car are aligned parallel to each other, in particular the third cable strand portions may be vertically aligned. The two cable strands of the second car can consequently be led vertically upward or downward in each case in their third cable strand portion.

In the case of a preferred embodiment of the invention, the third cable strand portions extend as far as a third deflecting roller or as far as the traction sheave of the second car, at which they are joined to a fourth cable strand portion, the fourth cable strand portions of the two cable strands of the second car being aligned parallel to each other.

The fourth cable strand portions may extend from the traction sheave directly to the counterweight of the second car. In this case, the fourth cable strand portions run in a vertical direction.

Alternatively, it may be provided that the fourth cable strand portions are, for example, horizontally aligned.

The fourth cable strand portions may extend from the traction sheave of the second car as far as a third deflecting roller, at which they are joined to a fifth cable strand portion, the fifth cable strand portions of the two cable strands of the second car being aligned parallel to each other. It may be provided in particular that the fifth cable strand portions are vertically aligned.

In the case of a preferred embodiment of the invention, the fifth cable strand portions extend as far as the counterweight of the second car, that is to say the two cable strands of the second car have in each case a total of four deflections, three deflecting rollers and additionally the common traction sheave of the second car being used for each cable strand.

The invention is not restricted to a specific number of deflections for the two cable strands of the second car. However, as far as possible, both cable strands should undergo the same number of deflections. It is of particular advantage if the cable strands are deflected by the same angle at the deflecting locations and if the distances between the deflecting locations are the same for both cable strands. It is also advantageous if the sequence of the deflections is the same for the two cable strands and if the bending changes also take place at the same locations.

It is of particular advantage if the axis of rotation of the traction sheave associated with the second car is aligned parallel to a horizontal joining line, which joins the points of intersection of the first cable strand portions, joined onto the second car, of the two cable strands with a horizontal plane. It has been found that this makes it possible for the cables to be guided with particularly equal wear of the two cable strands.

The counterweights of the first and second cars can be made to travel within the shaft, preferably next to each other. This allows the cable strands of the two cars to be held directly on the respective counterweight, without it being necessary for the counterweight of the second car to have a through-opening through which the cable strand of the first car is led. The two counterweights can therefore have an identical construction, whereby the production costs of the elevator installation can be lowered.

In order to achieve the most equal possible wear of the two cable strands of the second car, it is of advantage if the cable tensions of the two cable strands are equal. The two cable strands are consequently also distinguished by virtually identical extension and slippage behavior.

The elevator installation may have more than two cars. A third car may be disposed underneath the second car, and there may also be further cars disposed in the shaft, likewise kept in the suspension ratio of 1:1 on separate cable strands, and it is possible to achieve the same advantages for guiding their cables if a cable guiding device according to the present invention is used.

The following description of two preferred embodiments of the invention serves for more detailed explanation in conjunction with the drawings.

DETAILED DESCRIPTION OF THE INVENTION

Figure 1:
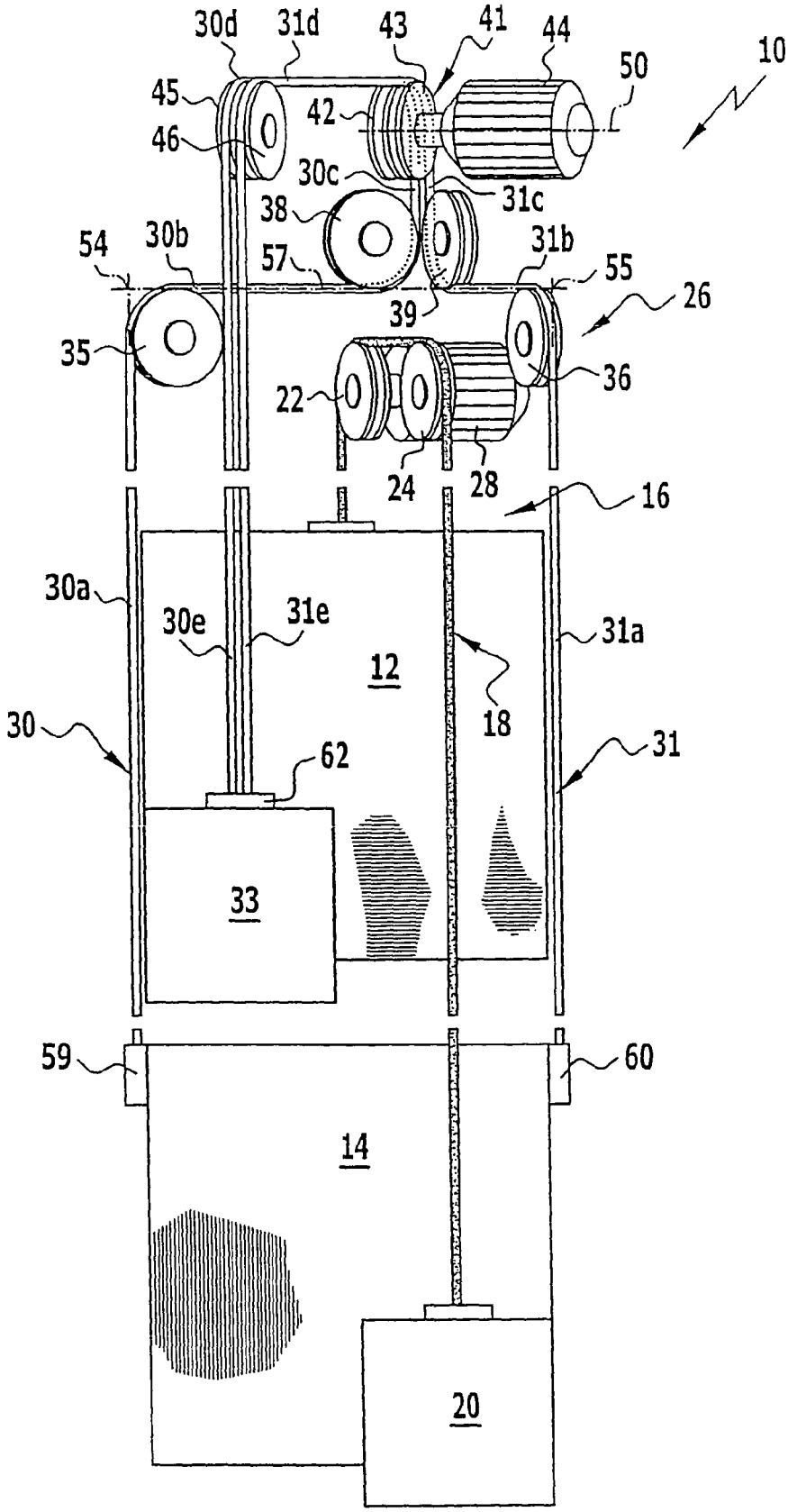
FIG. 1 shows a simplified graphic representation of an elevator installation, with two cars disposed one above the other, and a first embodiment of a cable guiding device.

In the drawing, an elevator installation 10 is schematically represented, with a first car 12 and a second car 14 disposed under it, which cars can be made to travel up and down separately from each other in a shaft 16. The first car 12 is connected to a counterweight 20 by means of a single cable strand 18, the cable strand 18 being led over a traction sheave 22 and a deflecting roller 24, which are held in a shaft region or machine space 26 disposed at the upper end of the shaft 16. The traction sheave 22 is driven by a drive motor 28, so that the first car can be made to travel up and down within the shaft 16. The cable strand 18 may comprise a number of individual cables.

The second car 14 is connected by means of two cable strands 30, 31 to a separate counterweight 33, which is disposed laterally next to the counterweight 20 of the first car 12. The two cable strands 30, 31 of the second car 14 may in each case comprise a number of individual cables. They are fixed to the car 14 on sides lying opposite each other, and therefore run laterally outside the first car 12, so that the latter is not hindered by the cable strands 30, 31. Starting from the second car 14, there extends in each case a first cable strand portion 30*a* and 31*a*, respectively, in a vertical direction upward as far as a first deflecting roller 35 and 36, respectively, which is disposed within the upper shaft region or machine space 26 and is joined to a second cable strand portion 30*b* and 31*b*, respectively. The second cable strand portions 30*b*, 31*b* run in a horizontal direction as far as a second deflecting roller 38 and 39, respectively, at which they are in each case joined in a vertical direction to a third cable strand portion 30*c* and 31*c*, respectively. The cable strands 30 and 31 are deflected by 90° in each case both at the first deflecting roller 35 and 36, respectively, and at the second deflecting roller 38 and 39, respectively.

The third cable strand portions 30*c* and 31*c* extend in a vertical direction as far as a common traction sheave 41, which is driven by a drive motor 44 and has a first traction sheave part 42 and a second traction sheave part 43, lying directly against the latter. The traction sheave parts 42 and 43 may be connected rigidly, in particular integrally, to each other. The cable strand 30 is led around the first traction sheave part 42 and the cable strand 31 is led around the second traction sheave part 43. At the respective traction sheave part 42, 43, in the case of the embodiment represented in FIGS. 1 and 2, the cable strands 30 and 31, respectively, undergo a renewed deflection by 90°, so that the respective third cable strand portion 30*c* and 31*c*, respectively, is joined to a fourth cable strand portion 30*d* and 31*d*, respectively, which is horizontally aligned. The fourth cable strand portion 30*d* and 31*d*, respectively, is joined, after a third deflecting roller 45 and 46, respectively, to a fifth cable strand portion 30*e* and 31*e*, respectively, which is directed vertically downward and ends at the counterweight 33 of the second car 14. The third deflecting rollers 45 and 46 lie directly against each other. They may also be configured as a common, freely rotatable deflecting roller in the form of a single component.

Figure 2:
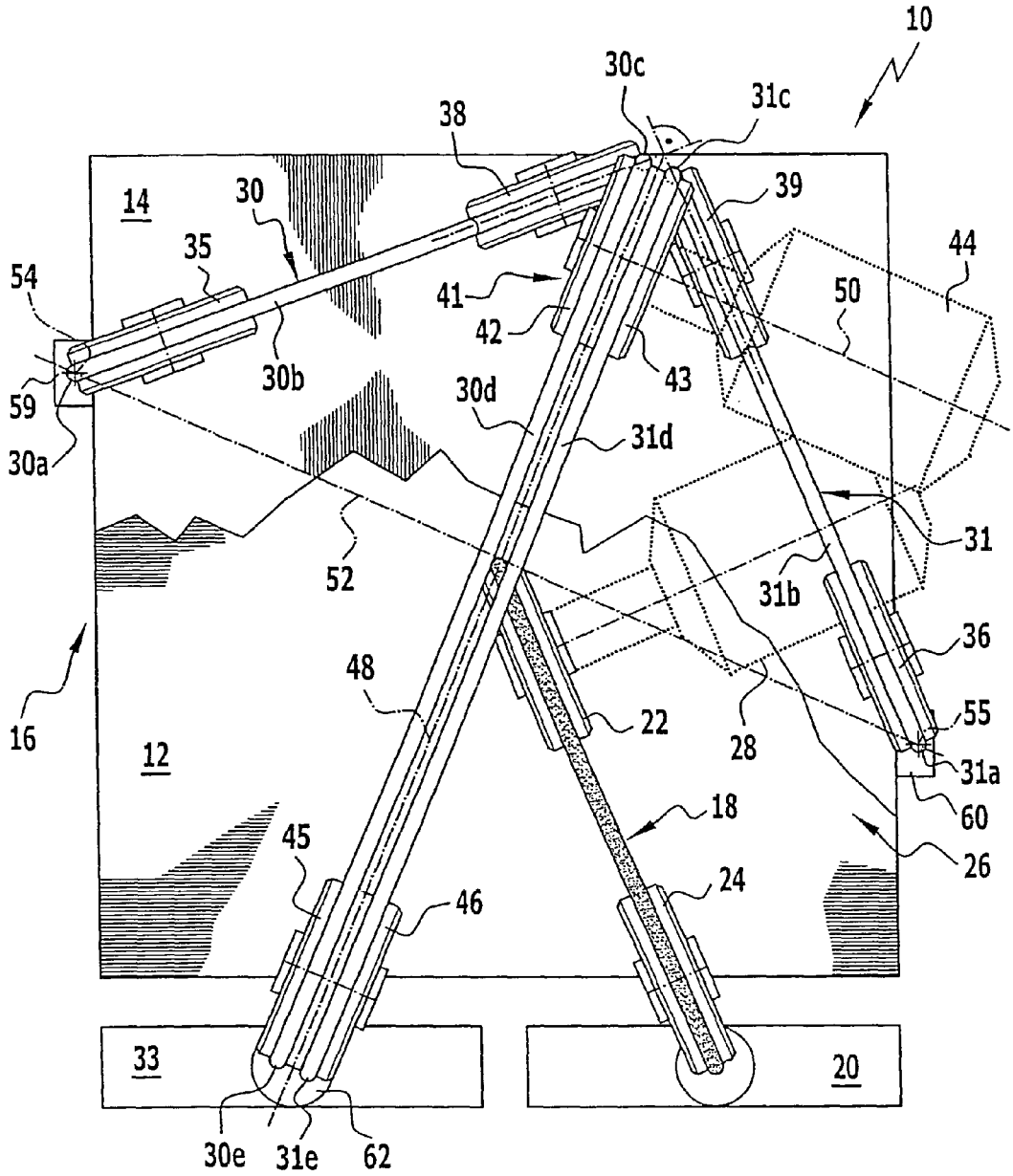
FIG. 2 shows a schematic plan view of the elevator installation from FIG. 1

As is clear in particular from FIG. 2, the two cable strands 30, 31 of the second car 14 run mirror-symmetrically in relation to each other with respect to a plane of symmetry 48, the first cable strand portions 30*a*, 31*a* as well as the third, fourth and fifth cable strand portions 30*c*, 31*c*; 30*d*, 31*d* and 30*e*, 31*e* running parallel to the plane of symmetry and the second cable strand portions 30*b*, 31*b* being inclined in each case at the same angle in relation to the plane of symmetry.

It is also clear from FIG. 2 that the axis of rotation 50 of the traction sheave 41 of the second car 14 runs parallel to a joining line 52, which joins to each other the imaginary points of intersection 54, 55 of the first cable strand portions 30*a*, 31*a* with the horizontal plane 57 defined by the two cable strand portions 30*b*, 31*b*. The joining line 52 runs perpendicularly in relation to the fourth cable strand portion 30*d*, 31*d*.

The two cable strands 30 and 31 each have the same cable tension and the sequence of the changes in direction taking place at the deflecting rollers 35, 36, 38, 39, 45, 46 and the traction sheave 41 is identical for the two cable strands 30, 31. The cable strands 30 and 31 in each case undergo a single bending change in the region between the second car 14 and the counterweight 33, since the running-around direction which the cable strands 30, 31 have at their respective first deflecting roller 35 and 36 is opposite to the running-around direction at the respectively second deflection roller 38 and 39, while the running-around direction is in each case identical in the region of the second deflecting rollers 38, 39 as well as in the region of the traction sheave 41 and the third deflecting rollers 45, 46. The distance between the first deflecting roller 35 and the second deflecting roller 38 of the cable strand 30 is identical to the distance between the first deflecting roller 36 and the second deflecting roller 39 of the cable strand 31. The same applies correspondingly to the distances between the second deflecting rollers 38 and 39, respectively, and the traction sheave 41 and also to the distances between the traction sheave 41 and the third deflecting rollers 45 and 46, respectively. The distances between the respective cable fastening points 59 and 60 of the two cable strands 30, 31 to the second car 14 and the respective first deflecting roller 35 and 36 as well as the distances between the third deflecting rollers 45 and 46, respectively, and the common cable fastening points 62 of the two cable strands 30, 31 to the counterweight 33 are also identical.

Figure 3:
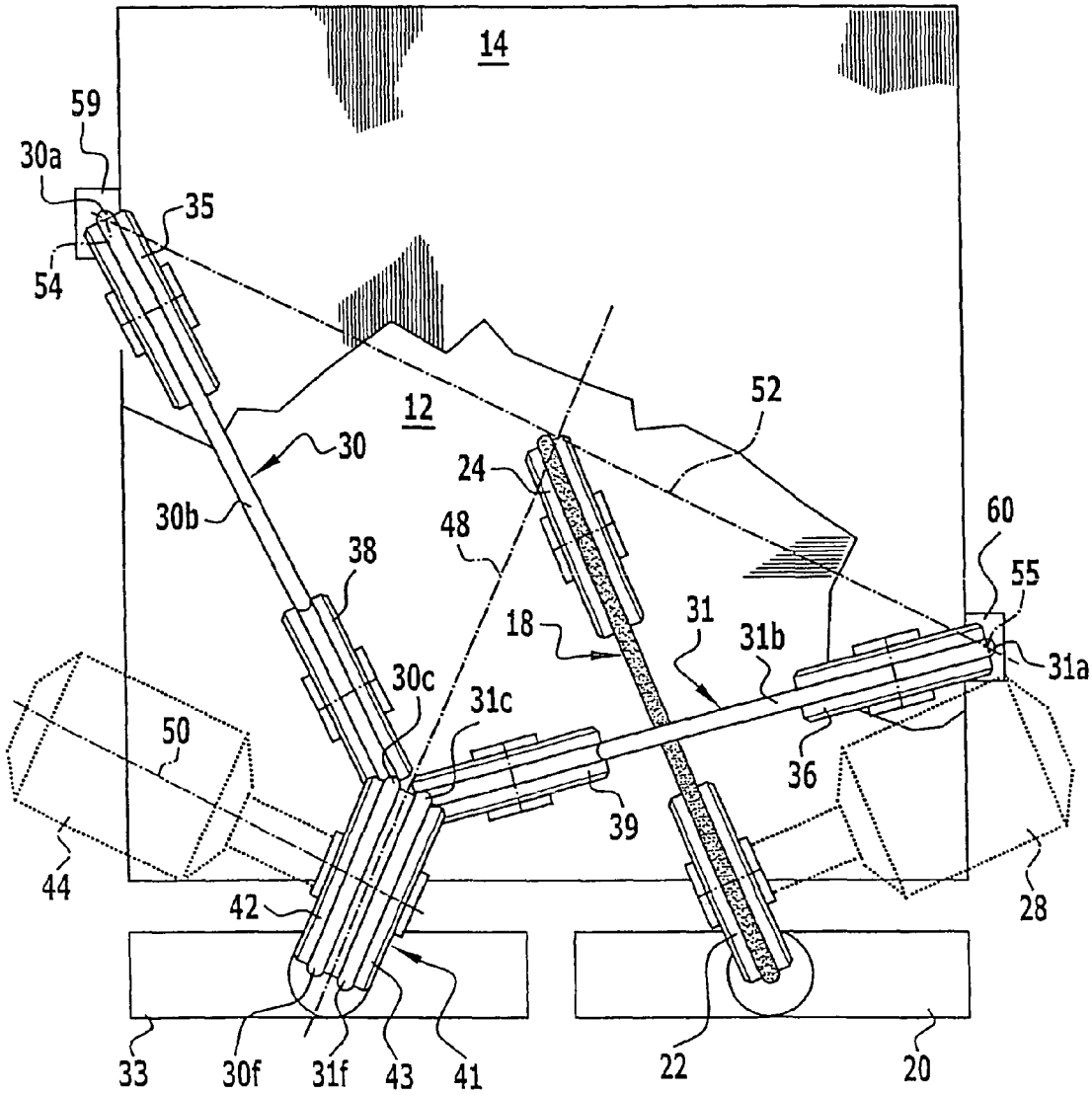
FIG. 3 shows a schematic plan view corresponding to FIG. 2 of an elevator installation with a second embodiment of a cable guiding device.

In FIG. 3, a plan view of an elevator installation according to the invention with a second embodiment of a cable guiding device is schematically represented. The elevator installation is largely identical to the elevator installation 10 represented in FIGS. 1 and 2 and explained above. Therefore, the same reference numerals as in FIGS. 1 and 2 are used for identical components in FIG. 3. To avoid repetition, reference is made in this respect to the explanations given above.

In the case of the embodiment represented in FIG. 3, starting from the first car 12, the cable strand 18 first runs over the deflecting roller 24 and then, after a deflection by 90° and a horizontal cable strand portion, meets the traction sheave 22. From the latter, the cable strand 18 extends in a vertical direction directly to the counterweight 20.

In a way corresponding to the embodiment represented in FIGS. 1 and 2, in the case of the embodiment according to FIG. 3, too, the second car 14 is connected by means of two cable strands 30, 31 to a counterweight 33, which is disposed laterally next to the counterweight 20 of the first car 12. The two cable strands 30, 31 are fixed to the car 14 on sides lying opposite each other, and run laterally outside the first car 12 past the latter. A first cable strand portion 30*a* and 31*a*, respectively, extends from the second car 14 upward in a vertical direction as far as a first deflecting roller 35 and 36, respectively, which is disposed within the upper shaft region or machine space 26 and at which it is joined to a second cable strand portion 30*b* and 31*b*, respectively. As a difference from the first embodiment represented in FIGS. 1 and 2, the second cable strand portions 30*b*, 31*b* run in the direction of the side of the car 14 that is facing the counterweight 33 of the second car 14. They run in a horizontal direction as far as a second deflecting roller 38 and 39, respectively, at which it is in each case joined upwardly in a vertical direction to a third cable strand portion 30*c* and 31*c*, respectively. The cable strands 30 and 31 are deflected by 90° in each case both at the first deflecting roller 35 and 36, respectively, and at the second deflecting roller 38 and 39, respectively.

The third cable strand portions 30*c* and 31*c* extend in a vertical direction as far as the common traction sheave 41, which has the two traction sheave parts 42 and 43, which lie directly against each other and over each of which a cable strand 30 and 31, respectively, of the second car 14 is led. The cable strands 30 and 31 undergo a deflection by 180° at the respective traction sheave part 42 and 43. This has the consequence that, in the case of the embodiment represented in FIG. 3, the respective third cable strand portion 30*c* and 31*c* is joined to a vertically aligned fourth cable strand portion 30*f* and 31*f*, respectively, which extends from the traction sheave 41 directly to the counterweight 33.

Both in the case of the first embodiment, represented in FIGS. 1 and 2, and in the case of the second embodiment, represented in FIG. 3, the two cable strands 30, 31 of the second car 14 are subjected to virtually the same cable loading during the operation of the elevator installation 10, and for this reason also have virtually the same wear. This has the result that the two cable strands 30, 31 reach their maximum permissible degree of wear at approximately the same point in time, when they must be exchanged. The extension and slippage behavior of the cable strands 30 and 31 is also virtually identical. The exchange of the cable strands 30 and 31 can be carried out at the same time and the cable strands 30, 31 can both be used out optimally. As a result, the operating costs of the elevator installation 10 can be kept relatively low.

The invention claimed is:

1. Elevator installation with a number of cars in a shaft, comprising:

at least a second car disposed underneath a first car, a drive with a traction sheave and at least one cable strand associated with each car, said at least one cable strand being led over the traction sheave and connecting the associated car to a counterweight, and the second car being kept in a suspension ratio of 1:1 and being connected to its counterweight by means of two cable strands associated with respective cable fastening points on different sides of the second car, said two cable strands being led over the traction sheave of the second car, each of said two cable strands comprising a first cable strand portion leading from the respective cable fastening point to a respective first deflecting roller and a second cable strand portion as a continuation of said first cable strand portion, said second cable strand portions leading from the respective first deflecting rollers and converging on one another in a direction of a further side of the second car, the traction sheave associated with the second car being offset from a center of the second car when seen in a plan view and comprising two traction sheave parts, over each of which one of the two cable strands of the second car is led, a distance between the two traction sheave parts being less than a distance between the first cable strand portions of the two cable strands at said respective cable fastening points, and a cable guiding device comprising at least said respective deflecting rollers which subjects the two cable strands of the second car to equal loading.

2. Elevator installation according to claim 1, wherein the two traction sheave parts lie against each other.

3. Elevator installation according to claim 1, wherein the cable guiding device comprises a plurality of deflecting rollers, the two cable strands of the second car being led over the same number of deflecting rollers and over the traction sheave of the second car.

4. Elevator installation according to claim 1, wherein the cable guiding device comprises a plurality of deflecting rollers, distances between two adjacent deflecting rollers and between the traction sheave of the second car and deflecting rollers adjacent to this traction sheave being the same for both cable strands of the second car.

5. Elevator installation according to claim 1, wherein the cable guiding device comprises a plurality of deflecting rollers, a sequence of changes in direction that take place at the respective deflecting rollers and the traction sheave being the same for the two cable strands of the second car.

6. Elevator installation according to claim 1, wherein the cable guiding device comprises a plurality of deflecting rollers, the two cable strands of the second car being deflected respectively by an identical angle at mutually corresponding deflecting rollers and at the traction sheave of the second car.

7. Elevator installation according to claim 1, wherein the two cable strands of the second car run mirror-symmetrically in relation to each other with respect to a plane of symmetry.

8. Elevator installation according to claim 1, wherein the second cable strand portion is aligned perpendicularly in relation to the first cable strand portion.

9. Elevator installation according to claim 8, wherein the second cable strand portions are horizontally aligned.

10. Elevator installation according to claim 8, wherein:

each of the second cable strand portions extend as far as a second deflecting roller, each of the second cable strand portions are joined to a third cable strand portion at the second deflecting roller, and the third cable strand portions are aligned parallel to each other.

11. Elevator installation according to claim 10, wherein the third cable strand portions are vertically aligned.

12. Elevator installation according to claim 10, wherein:

the third cable strand portions extend as far as one of a third deflecting roller or the traction sheave of the second car, each of the third cable strand portions are joined to a fourth cable strand portion at said one of the third deflecting roller or the traction sheave of the second car, and the fourth cable strand portions are aligned parallel to each other.

13. Elevator installation according to claim 12, wherein the fourth cable strand portions extend from the traction sheave directly to the counterweight of the second car.

14. Elevator installation according to claim 12, wherein the fourth cable strand portions are horizontally aligned.

15. Elevator installation according to claim 12, wherein:

the fourth cable strand portions extend from the traction sheave of the second car as far as a third deflecting roller, each of the fourth cable strand portions are joined to a fifth cable strand portion, and the fifth cable strand portions are aligned parallel to each other.

16. Elevator installation according to claim 15, wherein the fifth cable strand portions are vertically aligned.

17. Elevator installation according to claim 15, wherein the fifth cable strand portions extend as far as the counterweight of the second car.

18. Elevator installation according to claim 1, wherein an axis of rotation of the traction sheave associated with the second car is aligned parallel to a horizontal joining line, which joins points of intersection of the first cable strand portions, joined onto the second car, of the two cable strands with a horizontal plane.

19. Elevator installation according to claim 1, wherein cable tensions of the two cable strands of the second car are equal.

* * * * *